US011982471B2

(12) United States Patent
Welch

(10) Patent No.: US 11,982,471 B2
(45) Date of Patent: May 14, 2024

(54) CONDITIONING SYSTEM INCLUDING VAPOR COMPRESSION SYSTEM AND EVAPORATIVE COOLING SYSTEM

(71) Applicant: Copeland LP, Sidney, OH (US)

(72) Inventor: Andrew M. Welch, Franklin, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/732,934

(22) Filed: Apr. 29, 2022

(65) Prior Publication Data

US 2023/0349600 A1 Nov. 2, 2023

(51) Int. Cl.

*F25B 19/00* (2006.01)
*F25B 37/00* (2006.01)
*F25B 39/00* (2006.01)

(52) U.S. Cl.

CPC ..... *F25B 19/005* (2013.01); *F25B 37/00* (2013.01); *F25B 39/00* (2013.01)

(58) Field of Classification Search

CPC ..... F25B 19/005; F25B 37/00; F25B 39/00; F25B 13/00; F25B 25/005; F24F 5/001; F24F 5/0035; F24F 6/02; F24F 6/04; F24F 2203/02; F24F 2203/021

See application file for complete search history.

(56) References Cited

U.S. PATENT DOCUMENTS 4,941,324 A 7/1990 Peterson et al.
5,320,166 A * 6/1994 Swenson ..... F24F 5/0017 165/240
6,282,919 B1 * 9/2001 Rockenfeller ..... C09K 5/047 62/480
10,655,870 B2 5/2020 Lowenstein
(Continued)

FOREIGN PATENT DOCUMENTS

CN 102213471 B 1/2013
CN 105737302 A 7/2016
(Continued)

OTHER PUBLICATIONS

Invitation to Pay Additional Fees issued by the International Searching Authority in International Application No. PCT/US2023/062261 mailed on Jun. 19, 2023; pp. 1-10.

*Primary Examiner* — Len Tran
*Assistant Examiner* — Kamran Tavakoldavani
(74) *Attorney, Agent, or Firm* — Armstrong Teasdale LLP

(57) ABSTRACT

A conditioning system for a conditioned interior space includes a vapor compression system, an evaporative cooling system, and a controller. The vapor compression system includes an evaporator, a condenser, a refrigerant active fluid for flowing between the evaporator and the condenser, a first fan to produce a first airflow toward the conditioned interior space, and a second fan for producing a second airflow from the condenser toward an exterior space. The evaporative cooling system includes a first tank containing a non-refrigerant active fluid, and a heat exchange device fluidically coupled to the first tank to receive the non-refrigerant active fluid. The first fan is positioned to produce the first airflow through the heat exchange device toward the conditioned interior space. The controller is programmed to control cooperative operation of the vapor compression system and the evaporative cooling system to condition the conditioned interior space.

20 Claims, 14 Drawing Sheets

(56) References Cited

U.S. PATENT DOCUMENTS

| | | | | |
|---|---|---|---|---|
| 2005/0257551 | A1* | 11/2005 | Landry | F24F 3/1411 62/271 |
| 2014/0260367 | A1* | 9/2014 | Coutu | F24F 12/002 62/271 |
| 2017/0241654 | A1 | 8/2017 | Lowenstein | |
| 2017/0292722 | A1 | 10/2017 | Vandermeulen | |
| 2020/0363091 | A1* | 11/2020 | Umekage | F24F 1/0007 |
| 2022/0003464 | A1* | 1/2022 | Sakaguchi | F25B 41/20 |

FOREIGN PATENT DOCUMENTS

| | | | |
|---|---|---|---|
| EP | 1810856 | A2 | 7/2007 |
| WO | 2018191805 | A1 | 10/2018 |

* cited by examiner

CONDITIONING SYSTEM INCLUDING VAPOR COMPRESSION SYSTEM AND EVAPORATIVE COOLING SYSTEM

FIELD OF THE DISCLOSURE

The field of the disclosure relates generally to heating, ventilation, and air conditioning (HVAC) systems, and more specifically, to the use of evaporative cooling systems in HVAC systems.

BACKGROUND

The vapor compression cycle is widely used in air conditioning and heating systems to regulate the temperature and humidity of an indoor space. In typical air conditioning applications, air is cooled below its dew point temperature to allow moisture in the air to condense on an evaporator coil, thereby dehumidifying the air. Since this process often leaves the dehumidified air at an uncomfortably cold temperature, the air is then reheated to a temperature more comfortable to the occupant(s). The process of overcooling and reheating the air can become very energy-intensive and costly, particularly since the reheating process adds an additional heat load to the evaporator.

In some applications, vapor compression systems are used in parallel with humidity control systems to further condition the indoor space to a desired temperature and humidity. For example, a liquid desiccant humidity control system can condition the indoor space by absorbing moisture and reducing the humidity of the air, or by releasing moisture into the air to evaporatively cool the indoor space. However, the cost- and energy-efficiency of any such conditioning method depends on both the desired conditions and the actual ambient conditions, which can change throughout the year or even throughout the day. Additionally, the liquid desiccants used in such systems are often highly corrosive, and any carry-over of desiccant into the air stream can damage other parts of the system. Thus, there is a need for a conditioning system that can be operated to warm, cool, humidify, and/or dehumidify an indoor space by the most efficient method based on the desired and actual ambient conditions. There is a further need for a conditioning system that can effectively control the humidity of an indoor space while keeping the liquid desiccant fully isolated.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

A conditioning system for a conditioned interior space includes a vapor compression system, an evaporative cooling system, and a controller. The vapor compression system includes an evaporator, a condenser, a refrigerant active fluid for flowing between the evaporator and the condenser, a first fan to produce a first airflow toward the conditioned interior space, and a second fan for producing a second airflow from the condenser toward an exterior space. The evaporative cooling system includes a first tank containing a non-refrigerant active fluid, and a heat exchange device fluidically coupled to the first tank to receive the non-refrigerant active fluid. The first fan is positioned to produce the first airflow through the heat exchange device toward the conditioned interior space. The controller is programmed to control cooperative operation of the vapor compression system and the evaporative cooling system to condition the conditioned interior space.

An evaporative cooling system includes a first fan for producing a first airflow toward a conditioned interior space, a second fan for producing a second airflow toward an exterior space, a first tank containing a non-refrigerant active fluid, a second tank containing the non-refrigerant active fluid, a mass exchange device coupled in fluid communication between the first tank and the second tank to receive the non-refrigerant active fluid from the second tank and output the non-refrigerant active fluid to the first tank, a heat exchange device coupled in fluid communication with the first tank to receive the non-refrigerant active fluid, and a controller. The second fan is positioned to produce the second airflow through the mass exchange device, and the mass exchange device is configured to evaporate at least some of the non-refrigerant active fluid into the second airflow before the non-refrigerant active fluid is output to the first tank. The heat exchange device includes a direct heat exchanger, an indirect heat exchanger, and a valve for selecting whether to direct the non-refrigerant active fluid from the first tank to the direct heat exchanger or the indirect heat exchanger. The first fan is positioned to produce the first airflow through the heat exchange device toward the conditioned interior space. The controller is programmed to control operation of the evaporative cooling system to condition the conditioned interior space using one of the direct heat exchanger and the indirect heat exchanger.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

For conciseness, examples will be described with respect to a conditioning system that evaporatively cools an indoor space. However, the systems described herein may be applied to any suitable system for regulating the temperature and humidity of a space, including those that heat and/or dehumidify a space. The temperature and humidity of an indoor space can be independently regulated using a conditioning system that includes a vapor compression system and an evaporative cooling system. The vapor compression system can either cool or warm the air. The evaporative cooling system can directly or indirectly evaporatively cool the air, or it can dehumidify the air using a liquid desiccant loop to absorb moisture from the air.

Figure 1:
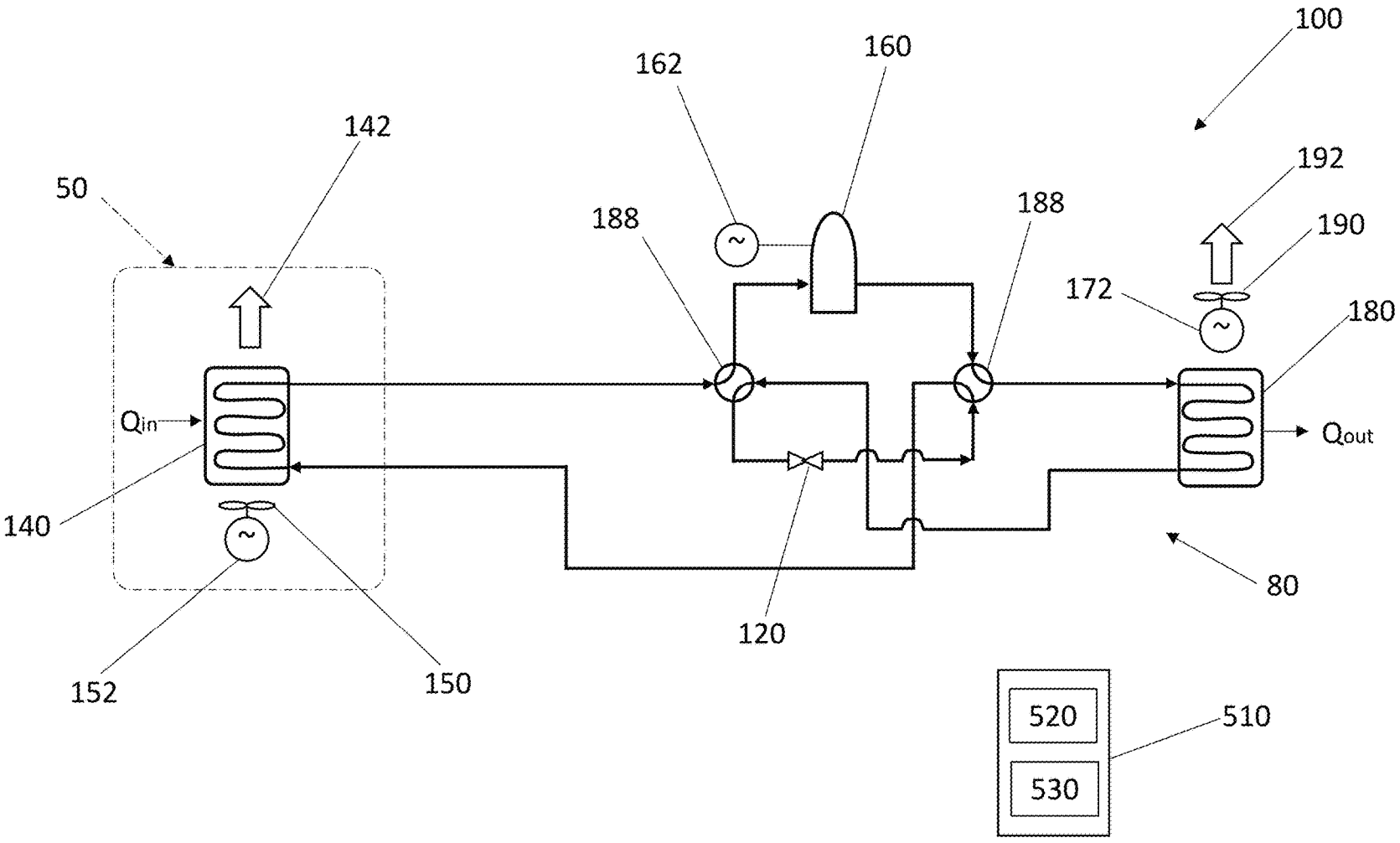
FIG. 1 is a schematic view of a vapor compression system.

FIG. 1 is a schematic diagram of a vapor compression system 100 for cooling a conditioned interior space 50 surrounded by an exterior space 80. The vapor compression system 100 has a single, closed refrigerant loop that includes an expansion device 120, an evaporator 140 (sometimes referred to as an indoor heat exchanger), a compressor 160, and a condenser 180 (sometimes referred to as an outdoor heat exchanger). A refrigerant active fluid flows through each component of the refrigerant loop. Refrigerant enters the expansion device 120 as a high-pressure liquid. The expansion device 120 reduces the pressure of the refrigerant such that it exits as low-pressure, low-temperature liquid. In some embodiments, the pressure may be reduced until the liquid refrigerant's current temperature becomes the boiling point temperature at that pressure, and the refrigerant becomes a two-phase mixture as some of the liquid refrigerant boils and turns into a gas. The expansion device 120 may be any type of expansion device that allows the vapor compression system 100 to function as descried herein, for example and without limitation, a fixed orifice, a thermal expansion valve, or an electronic expansion valve.

The expansion device 120 is fluidly coupled to the evaporator 140, which receives low-pressure, low-temperature liquid refrigerant at its inlet. In the evaporator 140, the refrigerant absorbs heat Qin from the conditioned interior space 50 to change phase from a liquid to a gas. A first fan 150 produces a first airflow 142 across the evaporator 140 toward the conditioned interior space 50, thereby cooling the conditioned interior space 50. In some embodiments, the conditioned interior space 50 is cooled to a temperature greater than the dew point temperature of the air. The first fan 150 may be driven by a first variable frequency drive (VFD) 152 or by any other suitable motor.

The evaporator 140 is fluidly coupled to the compressor 160, where it enters as a low-pressure, low-temperature gas. The compressor 160 is operable to compress the refrigerant by increasing the pressure of the refrigerant, for example, by adding kinetic energy to the refrigerant and converting it to a pressure rise. The compressor 160 may be any suitable compression device that allows the vapor compression system 100 to function as described herein, for example and without limitation, a dynamic compressor, a centrifugal compressor, an axial compressor, a scroll compressor, a rotary compressor, a screw compressor, a single-stage compressor, or a multi-stage compressor. The compressor 160 may be driven by a second VFD 162 or any other suitable motor. The refrigerant exits the compressor 160 as a high-pressure, high-temperature gas.

The compressor 160 is fluidly coupled to the condenser 180, where heat $Q_{out}$ is removed to condense the refrigerant into a high-pressure saturated or subcooled liquid. A second fan 190 produces a second airflow 192 from the condenser 180 toward the exterior space 80, thereby exhausting warm air toward the exterior space 80. The second fan 190 may be driven by a third VFD 172 or any other suitable motor. The condenser 180 is fluidly coupled to the expansion device 120, and the cycle begins again.

In some embodiments, the vapor compression system 100 shown in FIG. 1 can be used as a heating system, rather than as a cooling system. In such embodiments, a position of at least one four-way valve 188 can be switched to reverse the flow of refrigerant through the vapor compression system 100. As a result, the condenser 180 functions as an evaporator for absorbing heat from the exterior space 80, and the evaporator 140 functions as a condenser for heating the conditioned interior space 50. The vapor compression system 100 illustrated in FIG. 1 includes two four-way valves 188, but may have any suitable number of four-way valves 188 that allows the vapor compression system 100 to function as described herein, for example and without limitation, one, three, or more.

Figure 2:
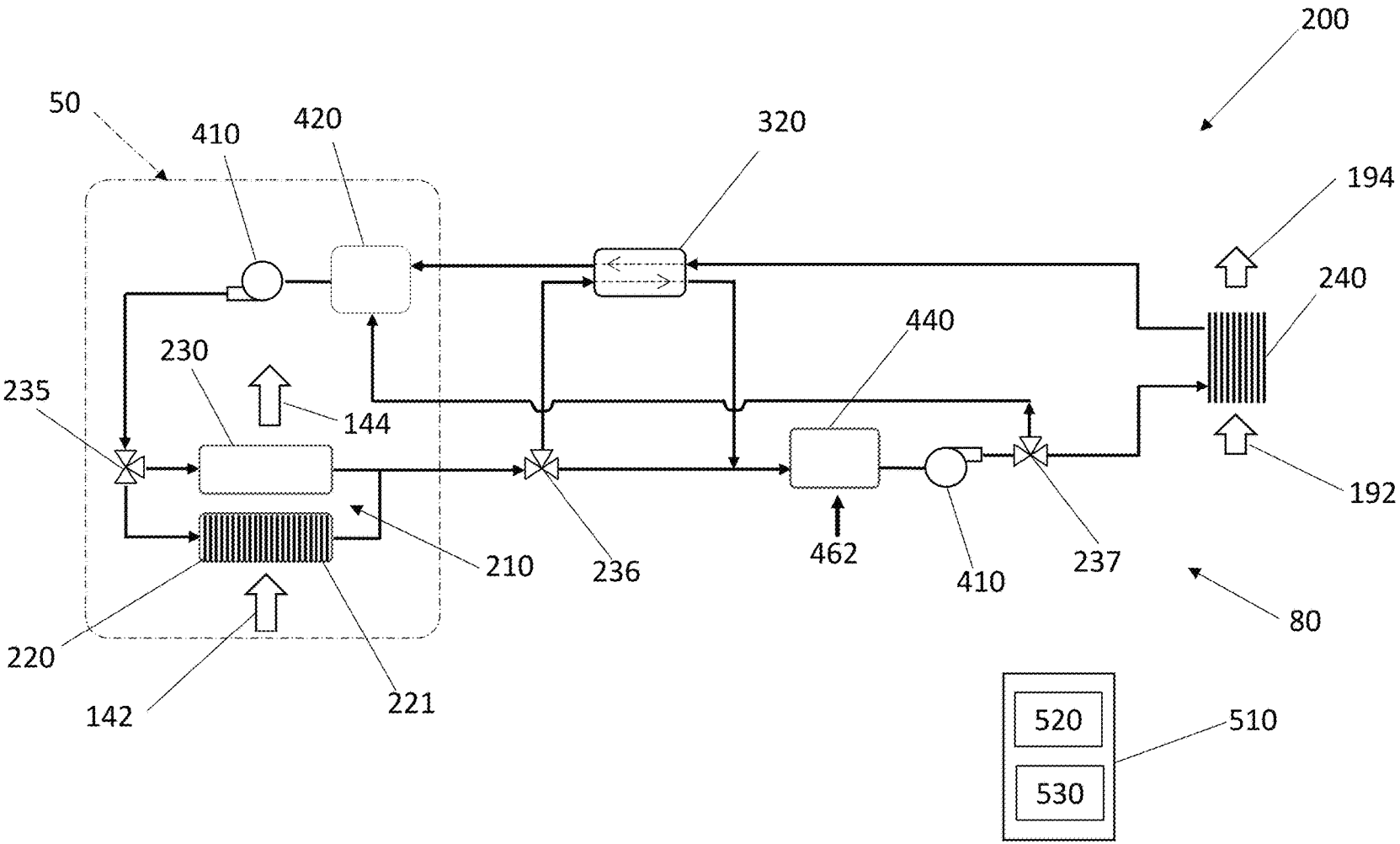
FIG. 2 is a schematic view of an evaporative cooling system that can be used in combination with the vapor compression system shown in FIG. 1.

FIG. 2 illustrates an evaporative cooling system 200 that may be used in combination with the vapor compression system 100. Although described in connection with the vapor compression system 100, the evaporative cooling system 200 may be used as a stand-alone evaporative cooling system without the vapor compression system 100, or may be used in connection with any other suitable HVAC system. The evaporative cooling system 200 is configured to permit a non-refrigerant active fluid to flow therethrough to condition the conditioned interior space 50. In the examples presented herein, the non-refrigerant active fluid comprises a mixture of a liquid desiccant, such as lithium chloride or calcium chloride, and water. However, any suitable non-refrigerant active fluid can be used that allows the evaporative cooling system 200 to function as described herein, for example and without limitation, a solution of only liquid desiccant or only water.

The evaporative cooling system 200 includes a first tank 420 for containing the non-refrigerant active fluid and a heat exchange device 210 fluidically coupled to the first tank 420 to receive non-refrigerant active fluid therefrom. The first tank 420 may be integral with the heat exchange device 210, and both components may be enclosed by a first housing (not shown). In further embodiments, the first tank 420 and heat exchange device 210 are not integral and are installed separately. In embodiments in which the evaporative cooling system 200 is used with the vapor compression system 100 shown in FIG. 1, the heat exchange device 210 is positioned in the first airflow 142 between the evaporator 140 and the conditioned interior space 50. The heat exchange device 210 includes a direct heat exchanger 220, an indirect heat exchanger 230, and a first valve 235 for selecting whether to direct the non-refrigerant active fluid to the direct heat exchanger 220 or the indirect heat exchanger 230.

When the first valve 235 is configured to direct the non-refrigerant active fluid through the direct heat exchanger 220, the non-refrigerant active fluid flows through a first fluid loop of the evaporative cooling system 200 to condition the conditioned interior space 50 via direct evaporative cooling. In such embodiments, liquid water in the non-refrigerant active fluid evaporates out of the direct heat exchanger 220 and into the surrounding air of the conditioned interior space 50, changing phase from a liquid to a gas and removing heat from the surrounding air in the process. The non-refrigerant active fluid is then cycled through a second tank 440 to replenish its supply of water. The first fluid loop is shown in FIG. 4, and its components and operation will be described in greater detail further below.

Figure 7:
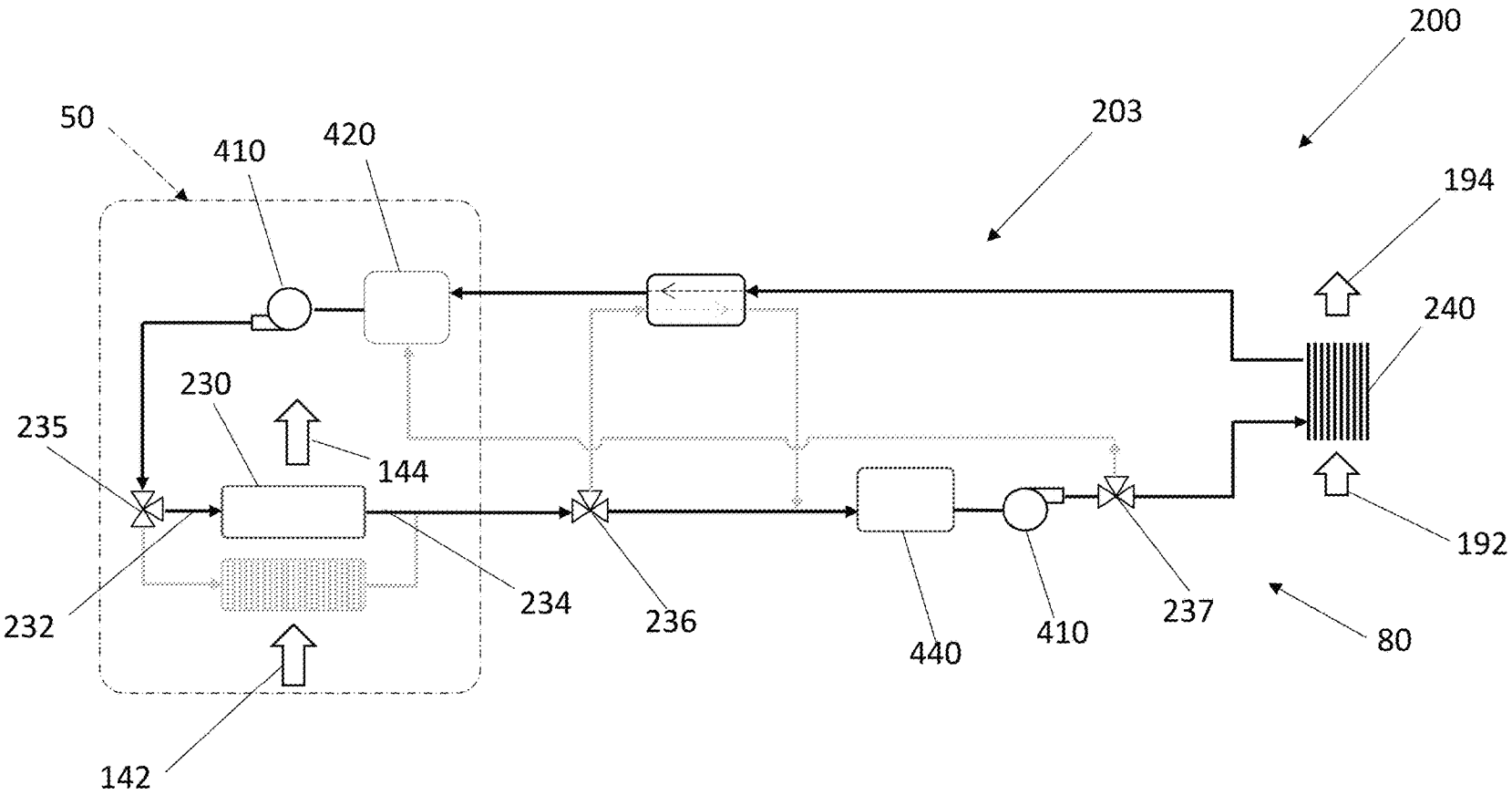
FIG. 7 is a schematic view of the evaporative cooling system shown in FIG. 2 highlighting a second fluid loop.

When the first valve is configured to direct the non-refrigerant active fluid through the indirect heat exchanger 230, the non-refrigerant active fluid flows through a second fluid loop of the evaporative cooling system 200 to condition the conditioned interior space 50 via indirect evaporative cooling. In such embodiments, liquid water evaporates out of a mass exchange device 240 into the surrounding air of the exterior space 80, leaving the remaining non-refrigerant active fluid at a lower temperature. The cooled non-refrigerant active fluid is then cycled through the indirect heat exchanger 230 to absorb and remove heat from the conditioned interior space 50. The second fluid loop is shown in FIG. 7, and its components and operation will be discussed in greater detail further below.

Figure 3:
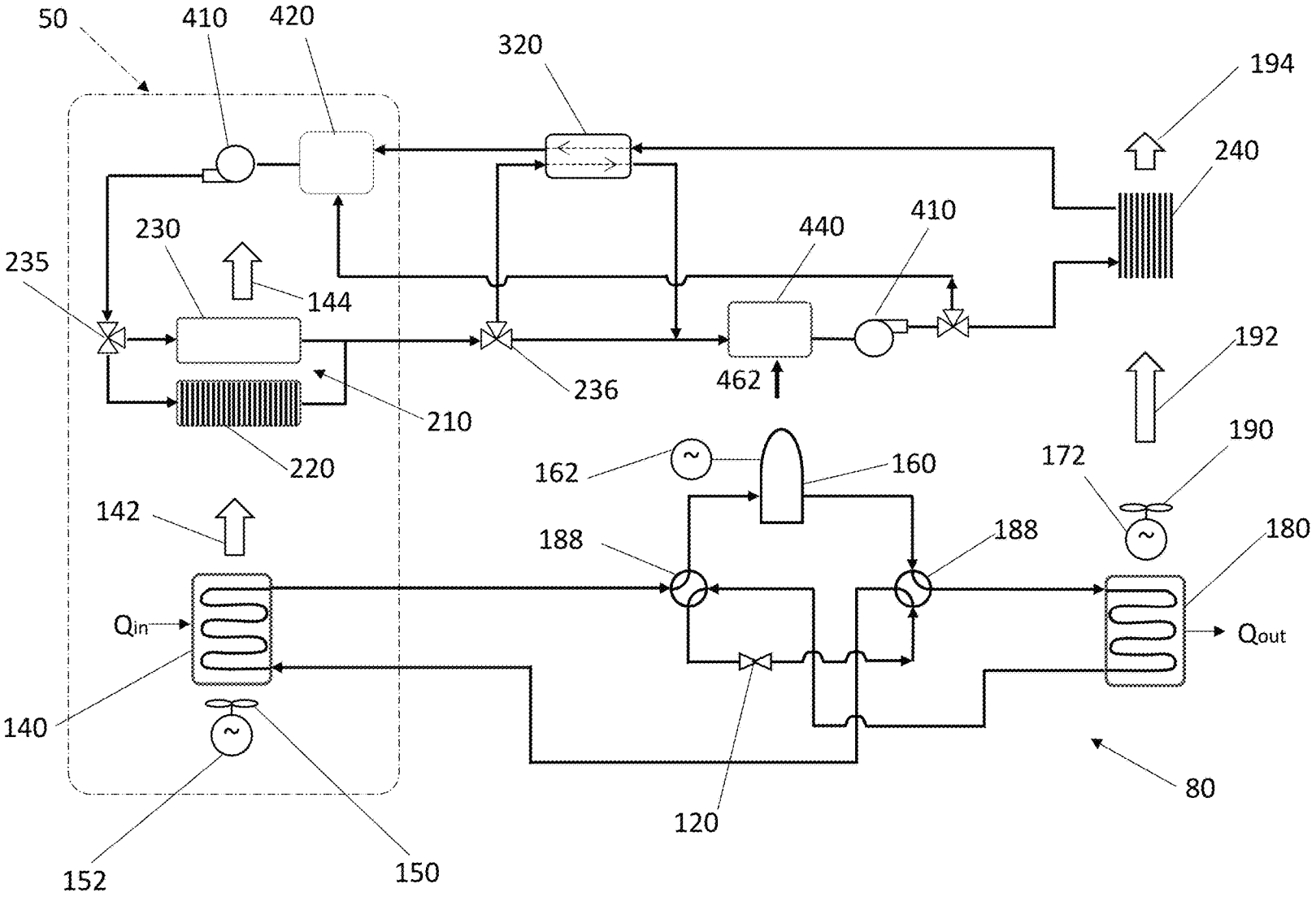
FIG. 3 is a schematic view of a conditioning system that includes the vapor compression system shown in FIG. 1 and the evaporative cooling system shown in FIG. 2.

FIG. 3 illustrates a conditioning system 300 that includes the vapor compression system 100 and the evaporative cooling system 200. In the illustrated embodiment, the evaporator 140 and the heat exchange device 210 are both located inside the conditioned interior space. The first airflow 142 generated by the first fan 150 flows across both the evaporator 140 and the heat exchange device 210 to be pre-conditioned and evaporatively cooled. Similarly, the condenser 180 and the mass exchange device 240 are both located in the exterior space 80. The second airflow 192 generated by the second fan 190 flows across the condenser 180 and the mass exchange device 240 to absorb moisture therefrom. The vapor compression system 100 and the evaporative cooling system 200 share no common components when used together to form the conditioning system 300, and are coupled in operation only by the first and second airflows 142, 192.

Figure 4:
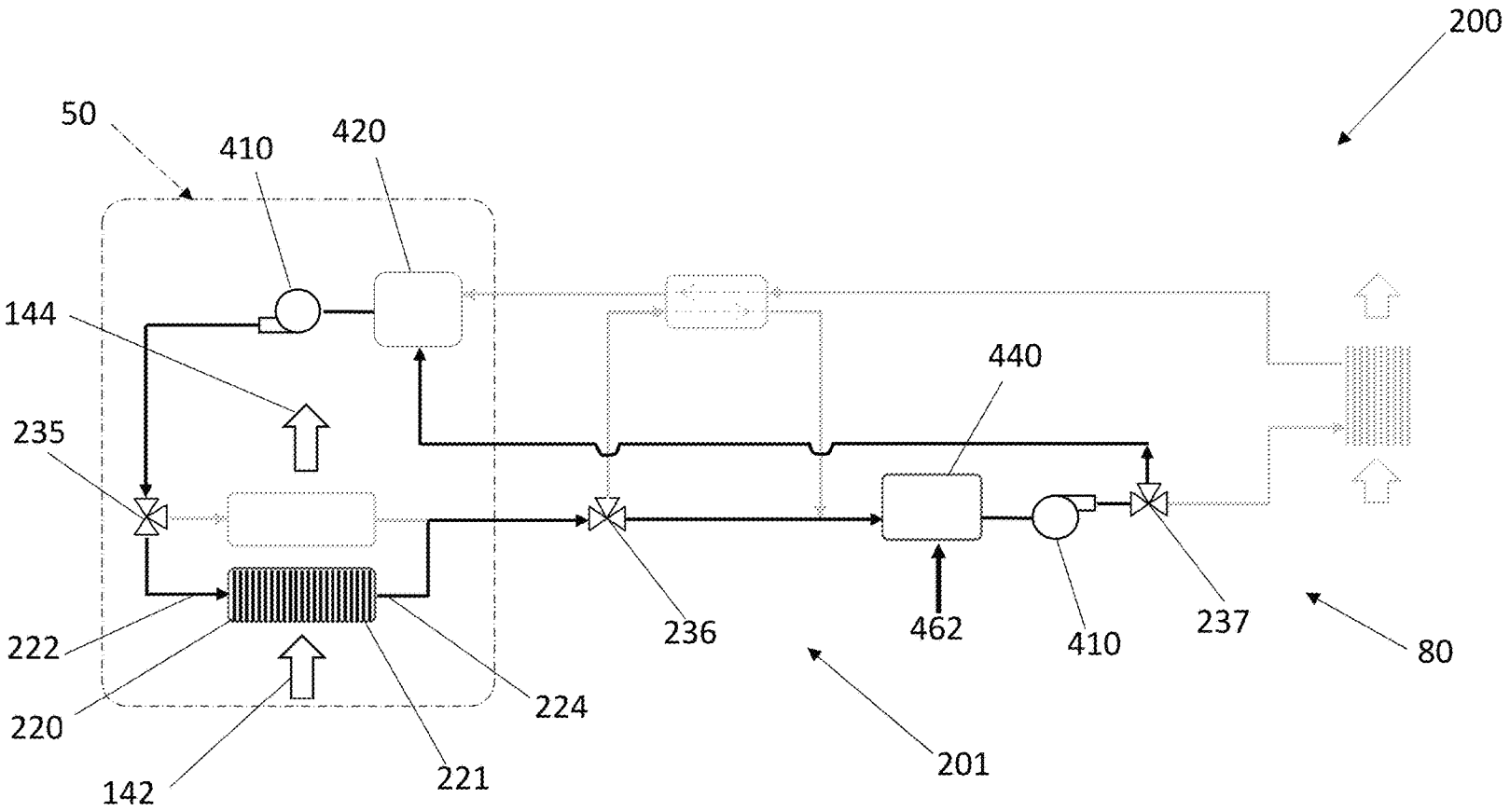
FIG. 4 is a schematic view of the evaporative cooling system shown in FIG. 2 highlighting a first fluid loop.

FIG. 4 illustrates operation of the evaporative cooling system 200 when the non-refrigerant active fluid flows through the first fluid loop to condition the conditioned interior space 50 via direct evaporative cooling. The first fluid loop 201 is shown in black, and portions of the evaporative cooling system 200 that are not part of the first fluid loop 201 are shown in grey. In the illustrated embodiment, the first valve 235 is configured to direct the non-refrigerant active fluid through the direct heat exchanger 220. The direct heat exchanger 220 comprises a heat and mass exchange device 221 operable to permit both heat and mass transfer between the non-refrigerant active fluid and the first airflow 142. The heat and mass exchange device 221 includes an inlet 222, an outlet 224, and an open fluid path 245 (FIG. 5) configured to permit the non-refrigerant active fluid to flow therethrough.

The first airflow 142 passes through the heat and mass exchange device 221. Because the non-refrigerant active fluid has a high water content and thus a higher vapor pressure than the first airflow 142, water evaporates out of the non-refrigerant active fluid and is absorbed by the first airflow 142. The evaporated water molecules absorb heat from the surrounding air to complete the phase change from liquid to gas, thereby reducing the temperature of the first airflow 142. After being directly evaporatively cooled in the heat and mass exchange device 221, the first airflow 142 enters the conditioned interior space 50 as a conditioned airflow 144.

Figure 5:
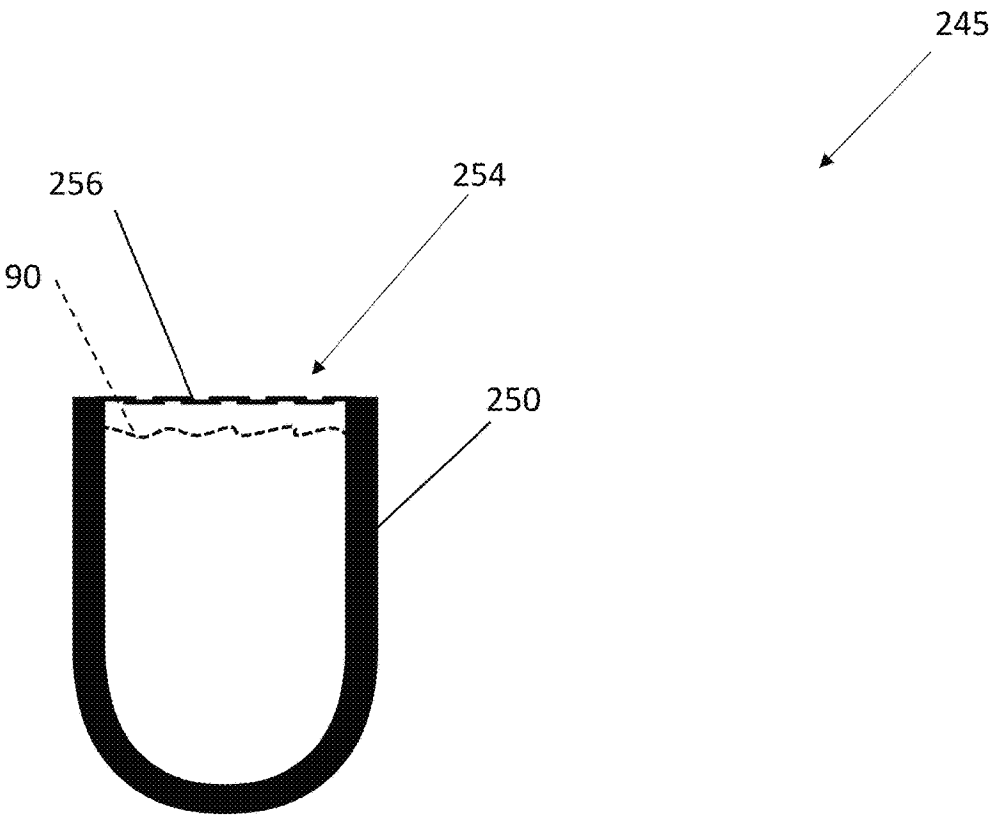
FIG. 5 is a cross-sectional view of an open fluid path of a heat and mass exchange device included in the evaporative cooling system shown in FIG. 2.

With reference to FIG. 5, the open fluid path 245 of the heat and mass exchange device 221 comprises a plurality of cavities 250 through which the non-refrigerant active fluid flows. In the illustrated embodiment, the cavity 250 has a U-shaped cross-section, but each cavity 250 may have any shape or cross-section that allows the heat and mass exchange device 221 to function as described herein, for example and without limitation, a rectangular, semi-circular, or V-shaped cross-section. Each cavity 250 may have the same cross-section, or different cavities 250 may have different cross-sections.

Figure 6:
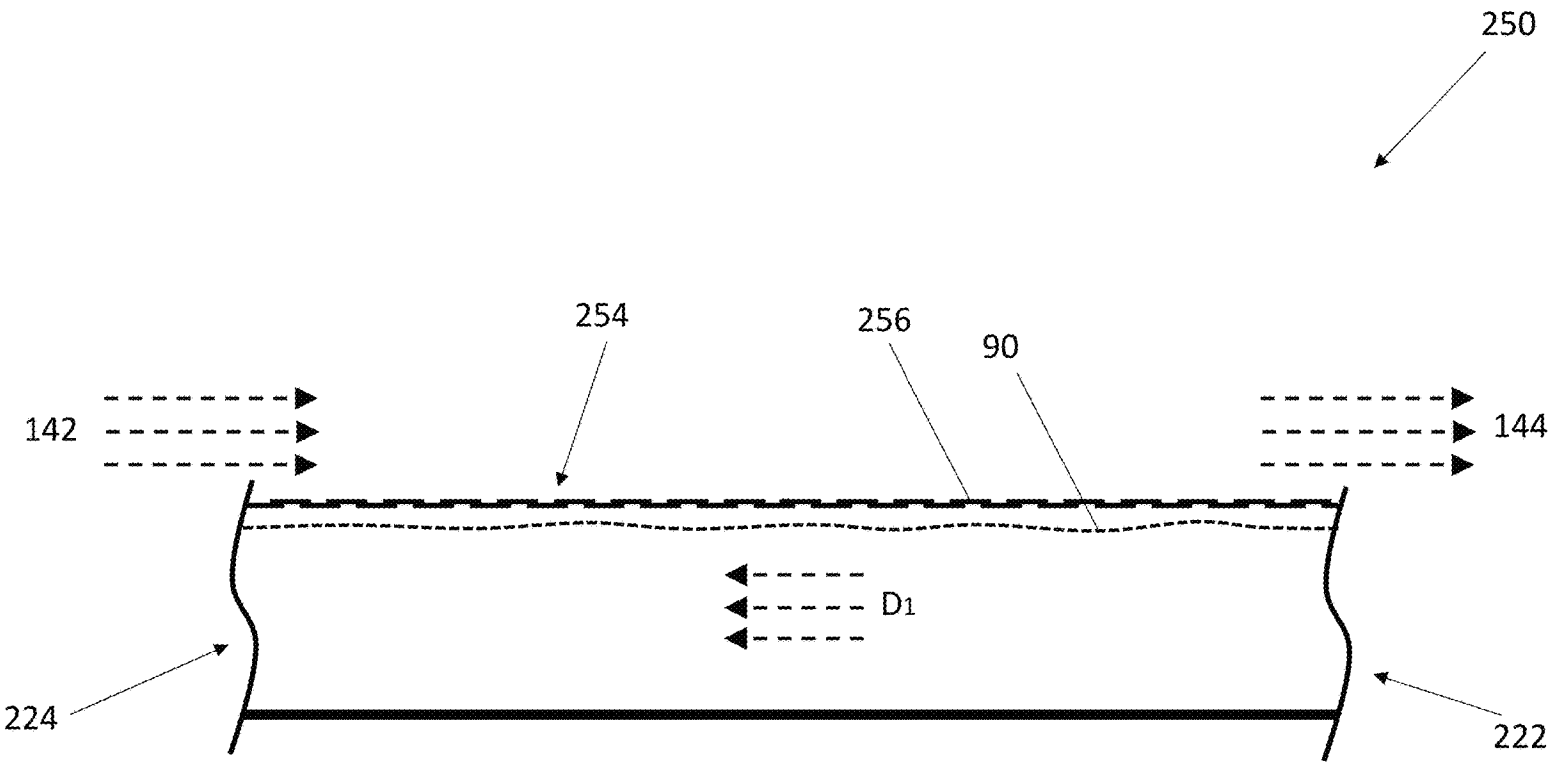
FIG. 6 is a side view of the open fluid path shown in FIG. 5.

With additional reference to FIG. 6, non-refrigerant active fluid flows through each of the plurality of cavities 250 in a direction $D_1$ opposite a direction of the first airflow 142. In further embodiments, the non-refrigerant active fluid may flow in the same direction as the first airflow 142. Each cavity 250 defines an open portion 254 positioned to be exposed to the first airflow 142. A surface 90 of the non-refrigerant active fluid is disposed proximate the open portion 254. In the U-shaped cavity 250 shown in FIG. 4, the open portion 254 is defined by the upper, non-rounded portion of the U-shape that is not bounded by a wall.

A vapor permeable membrane 256 covers the open portion 254 of each cavity 250 to separate the surface 90 of the non-refrigerant active fluid from the first airflow 142. The vapor permeable membrane 256 may include a plurality of pores that are sized to allow water vapor molecules to pass through while prohibiting the passage of larger molecules, such as molecules of liquid desiccant. Thus, the vapor permeable membrane 256 allows water vapor evaporated from the non-refrigerant active fluid to pass into the first airflow 142. The vapor permeable membrane 256 also prevents liquid desiccant from leaking out of the cavity 250 and into the first airflow 142. In further embodiments, the open portion 254 of each cavity 250 may be covered by a membrane that chemically absorbs water but not liquid desiccant. The difference in vapor pressure allows water to be absorbed from the cavity 250 and released into the conditioned interior space 50.

With reference to FIG. 4, the first fluid loop of the evaporative cooling system 200 additionally includes the second tank 440 downstream of the heat and mass exchange device 221. In the illustrated embodiment, the second valve 236 is configured to couple the heat and mass exchange device 221 in fluid communication with the second tank 440 to permit the non-refrigerant active fluid to flow from the heat and mass exchange device 221 to the second tank 440. The second tank 440 may include a connection 462 to receive water from an external water source, thereby diluting the liquid desiccant in the non-refrigerant active fluid with water to be evaporated into the conditioned interior space 50. The external water source can be a municipal water source, a well, or any other suitable source. Further embodiments do not include a connection to receive water from an external water source. A third valve 237 is configured to direct non-refrigerant active fluid to the first tank 420, and the cycle of the first fluid loop begins again.

FIG. 7 illustrates operation of the evaporative cooling system 200 when the non-refrigerant active fluid flows through the second fluid loop to condition the conditioned interior space 50 via indirect evaporative cooling. The second fluid loop is shown in black, and portions of the evaporative cooling system 200 that are not part of the second fluid loop are shown in grey. In the illustrated embodiment, the first valve 235 is configured to direct the non-refrigerant active fluid through the indirect heat exchanger 230, which will be described in greater detail further below.

In addition to the first tank 420 and the indirect heat exchanger 230, the second fluid loop also includes the second tank 440 for containing the non-refrigerant active fluid downstream of the indirect heat exchanger 230. In the illustrated embodiment, the second valve 236 is configured to couple the indirect heat exchanger 230 in fluid communication with the second tank 440 to permit the non-refrigerant active fluid to flow from the indirect heat exchanger 230 to the second tank 440. The non-refrigerant active fluid may be diluted with water in the second tank 440 from the connection 462 to an external water source. The second fluid loop also includes a mass exchange device 240 fluidically coupled to the second tank 440 to receive non-refrigerant active fluid therefrom. The second tank 440 may be integral with the mass exchange device 240, and both components may be enclosed by a second housing (not shown). In further embodiments, the second tank 440 and the mass exchange device 240 are not integral and are installed separately. In the illustrated embodiment, the third valve 237 is configured to direct non-refrigerant active fluid from the second tank 440 to the mass exchange device 240. The mass exchange device 240 is positioned between the condenser 180 of the vapor compression system 100 and the exterior space 80 such that the second fan 190 produces the second airflow 192 through the mass exchange device 240.

The mass exchange device 240 operates similarly to the heat and mass exchange device 221. Because the non-refrigerant active fluid has a higher vapor pressure than the surrounding air of the exterior space 80, water evaporates out of the non-refrigerant active fluid and is absorbed by the second airflow 192. Since the hottest water molecules evaporate out of the non-refrigerant active fluid, the temperature of the remaining non-refrigerant active fluid is reduced. After passing through the mass exchange device 240, the second airflow 192 enters the exterior space 80 as an exhaust flow 194.

The mass exchange device 240 may be constructed similarly to the heat and mass exchange device 221. That is, the mass exchange device 240 may include an open flow path comprising a plurality of cavities, each cavity having a vapor-permeable membrane that permits at least some water in the non-refrigerant active fluid to evaporate into the second airflow 192, as shown in FIGS. 5 and 6. In further embodiments, the mass exchange device 240 may have any other suitable construction that allows it to function as described herein. The mass exchange device 240 is upstream of and fluidly connected to the first tank 420 and outputs cooled non-refrigerant active fluid thereto, where it is subsequently supplied to the indirect heat exchanger 230.

The indirect heat exchanger 230 is configured to permit heat transfer, but not mass transfer, between the non-refrigerant active fluid and the first airflow 142. The indirect heat exchanger 230 includes an inlet 232, an outlet 234, and a sealed fluid path 270 (FIG. 8) positioned within the first airflow 142 and configured to permit the non-refrigerant active fluid to flow therethrough. After being cooled by the mass exchange device 240, the non-refrigerant active fluid flows through the indirect heat exchanger 230 and absorbs heat from the first airflow 142, thereby reducing the temperature of the first airflow 142. After being indirectly evaporatively cooled in the indirect heat exchanger, the first airflow 142 enters the conditioned interior space 50 as a conditioned airflow 144. The non-refrigerant active fluid flows onward to the second tank 440, and the cycle begins again.

Figure 8:
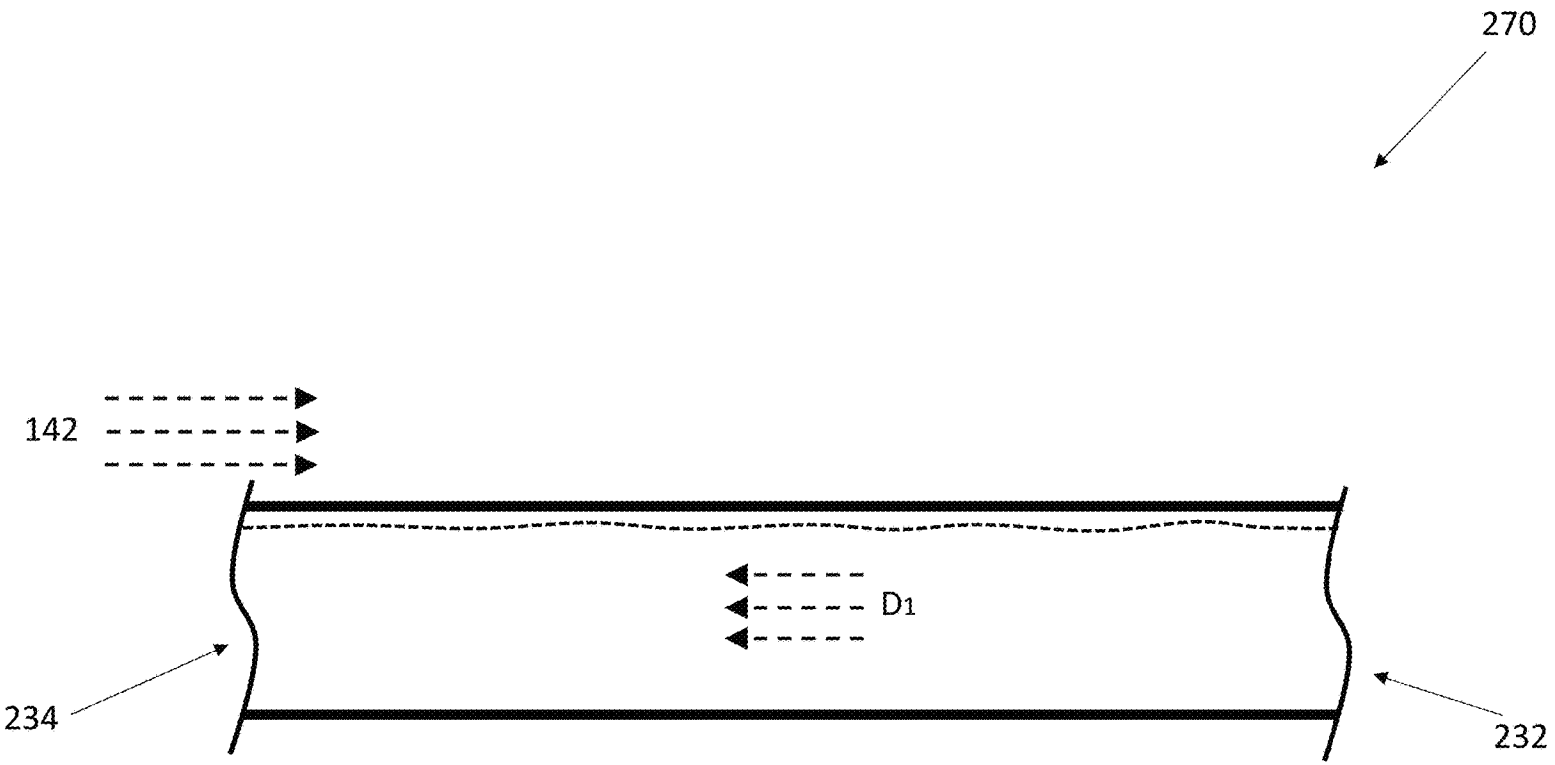
FIG. 8 is a side view of a sealed fluid path of an indirect heat exchanger included in the evaporative cooling system shown in FIG. 2.

The sealed fluid path 270 of the indirect heat exchanger 230 may be constructed as a single duct, a plurality of tubes, or with any other construction that allows the indirect heat exchanger 230 to function as described herein. With reference to FIG. 8, the sealed fluid path 270 is positioned to direct the flow of non-refrigerant active fluid counter to the first airflow 142. That is, non-refrigerant active fluid flows through the sealed fluid path 270 in the direction $D_1$ opposite the direction of the first airflow.

The volume of liquid desiccant in each of the first tank 420 and second tank 440 may remain constant; that is, non-refrigerant active fluid may be received in each tank at the same rate as it is provided to the heat exchange device 210 or the mass exchange device 240. Alternatively, the volume of non-refrigerant active fluid in each tank 420, 440 may vary over time to allow precise control of the rate at which non-refrigerant active fluid is provided to the heat exchange device 210 or the mass exchange device 240.

The evaporative cooling system 200 additionally includes at least one pump 410 configured to circulate non-refrigerant active fluid through the first or second fluid loop. The illustrated embodiment includes two pumps 410, but the evaporative cooling system 200 may include any suitable number of pumps 410, for example and without limitation, one, three, or more. In the illustrated embodiment, each pump 410 is located immediately downstream of one of the first tank 420 or second tank 440, and may either be integral with the respective tank or may be installed separately. Each pump 410 is operable to control the rate at which non-refrigerant active fluid is supplied from each tank 420, 440 to the heat exchange device 210 or the mass exchange device 240. The integration of at least one tank and at least one pump with the heat exchange device 210 and the mass exchange device 240 simplifies the system's piping and storage capabilities, and allows for the fluid pressure of the liquid desiccant within each heat or mass exchange device 210, 240 to be controlled within a small pressure range. The at least one pump 410 may be a centrifugal pump, diaphragm pump, reciprocating pump, vane pump, screw pump, gear pump, or any type of pump that allows the evaporative cooling system 200 to function as described herein.

Figure 9:
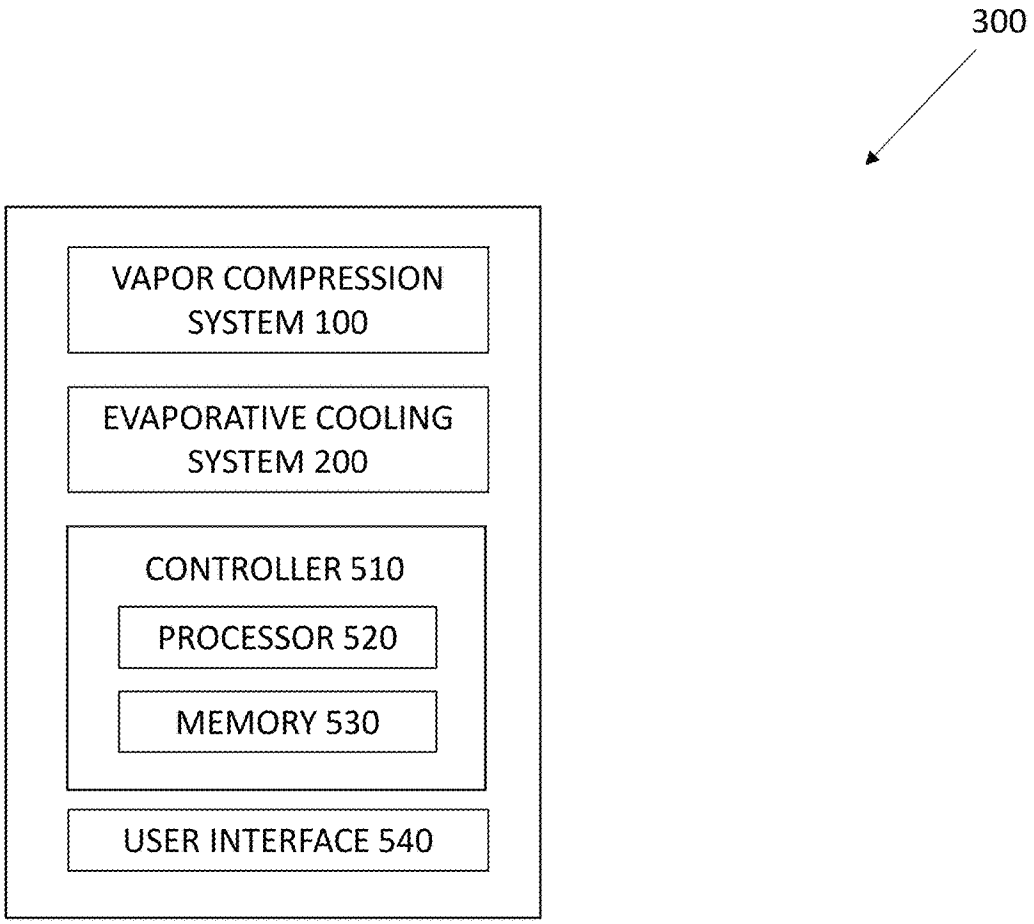
FIG. 9 is a block diagram of a control system for the conditioning system shown in FIG. 3.

With reference to FIG. 9, the conditioning system 300 includes a controller 510 programmed to control cooperative operation of the vapor compression system 100 and the evaporative cooling system 200 to cooperatively condition the conditioned interior space 50 to a desired temperature and/or humidity level. The controller 510 includes a processor 520 and a memory 530. The memory 530 stores instructions that program the processor 520 to operate the vapor compression system 100 to control the temperature of the conditioned interior space 50 to a temperature setpoint. The controller 510 is further programmed to operate the evaporative cooling system 200 in conjunction with the vapor compression system 100, and to further condition the conditioned interior space 50 using one of the direct heat exchanger 220 and the indirect heat exchanger 230.

The controller 510 is configured to control at least one operating parameter of the conditioning system 300, for example and without limitation, a speed of the first or second fan 150, 190, a position of a three-way valve 235, 236, 237, a position of a four-way valve 188, a speed of the compressor 160, or a speed of the at least one pump 410. For example, the controller 510 is configured to control the position of the first valve 235 to direct the non-refrigerant active fluid to either the direct heat exchanger 220 or the indirect heat exchanger 230. When the controller programs operation of the evaporative cooling system 200 to condition the conditioned interior space 50 using the direct heat exchanger 220, the controller 510 is additionally configured to control the second valve 236 to bypass the mass exchange device 240. The controller 510 may control these parameters in response to at least one measured or calculated property of the air in the conditioned interior space 50, for example and without limitation, a dew point temperature, wet bulb temperature, partial pressure of water vapor, or humidity ratio.

The conditioning system 300 further includes a user interface 540 configured to output (e.g., display) and/or receive information (e.g., from a user) associated with the conditioning system 300. In some embodiments, the user interface 540 is configured to receive an activation and/or deactivation input from a user to activate and deactivate (i.e., turn on and off) or otherwise enable operation of the conditioning system 300. For example, the user interface 540 can receive a temperature setpoint and a humidity setpoint specified by the user. Moreover, in some embodiments, the user interface 540 is configured to output information associated with one or more operational characteristics of the conditioning system 300, including, for example and without limitation, warning indicators such as severity alerts, occurrence alerts, fault alerts, motor speed alerts, and any other suitable information.

The user interface 540 may include any suitable input devices and output devices that enable the user interface 540 to function as described herein. For example, the user interface 540 may include input devices including, but not limited to, a keyboard, mouse, touchscreen, joystick(s), throttle(s), buttons, switches, and/or other input devices. Moreover, the user interface 540 may include output devices including, for example and without limitation, a display (e.g., a liquid crystal display (LCD) or an organic light emitting diode (OLED) display), speakers, indicator lights, instruments, and/or other output devices. Furthermore, the user interface 540 may be part of a different component, such as a system controller (not shown). Other embodiments do not include a user interface 540.

The controller 510 is generally configured to control operation of the conditioning system 300. The controller 510 controls operation through programming and instructions from another device or controller or is integrated with the conditioning system 300 through a system controller. In some embodiments, for example, the controller 510 receives user input from the user interface 540, and controls one or more components of the conditioning system 300 in response to such user inputs. For example, the controller 510 may control the first fan 150 based on user input received from the user interface 540. In some embodiments, the conditioning system 300 may be controlled by a remote control interface. For example, the conditioning system 300 may include a communication interface (not shown) configured for connection to a wireless control interface that enables remote control and activation of the conditioning system 300. The wireless control interface may be embodied on a portable computing device, such as a tablet or smartphone.

The controller 510 may generally include any suitable computer and/or other processing unit, including any suitable combination of computers, processing units and/or the like that may be communicatively coupled to one another and that may be operated independently or in connection within one another (e.g., controller 510 may form all or part of a controller network). Controller 510 may include one or more modules or devices, one or more of which is enclosed within the conditioning system 300, or may be located remote from the conditioning system 300. The controller 510 may be part of the vapor compression system 100, the evaporative cooling system 200, or it may be part of a system controller in an HVAC system. Controller 510 and/or components of controller 510 may be integrated or incorporated within other components of the conditioning system 300. The controller 510 may include one or more processor(s) 520 and associated memory device(s) 530 configured to perform a variety of computer-implemented functions (e.g., performing the calculations, determinations, and functions disclosed herein).

As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 530 of controller 510 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 530 may generally be configured to store suitable computer-readable instructions that, when implemented by the processor(s) 520, configure or cause the controller 510 to perform various functions described herein including, but not limited to, controlling the conditioning system 300, receiving inputs from user interface 540, providing output to an operator via user interface 540, and/or various other suitable computer-implemented functions.

In some embodiments, the controller is programmed to control operation of the conditioning system 300 to heat, rather than cool, the conditioned interior space 50. For example, the controller 510 may control the position of the at least one four-way valve 188 in the vapor compression system 100 to reverse the direction of refrigerant flow through the system.

Figure 10:
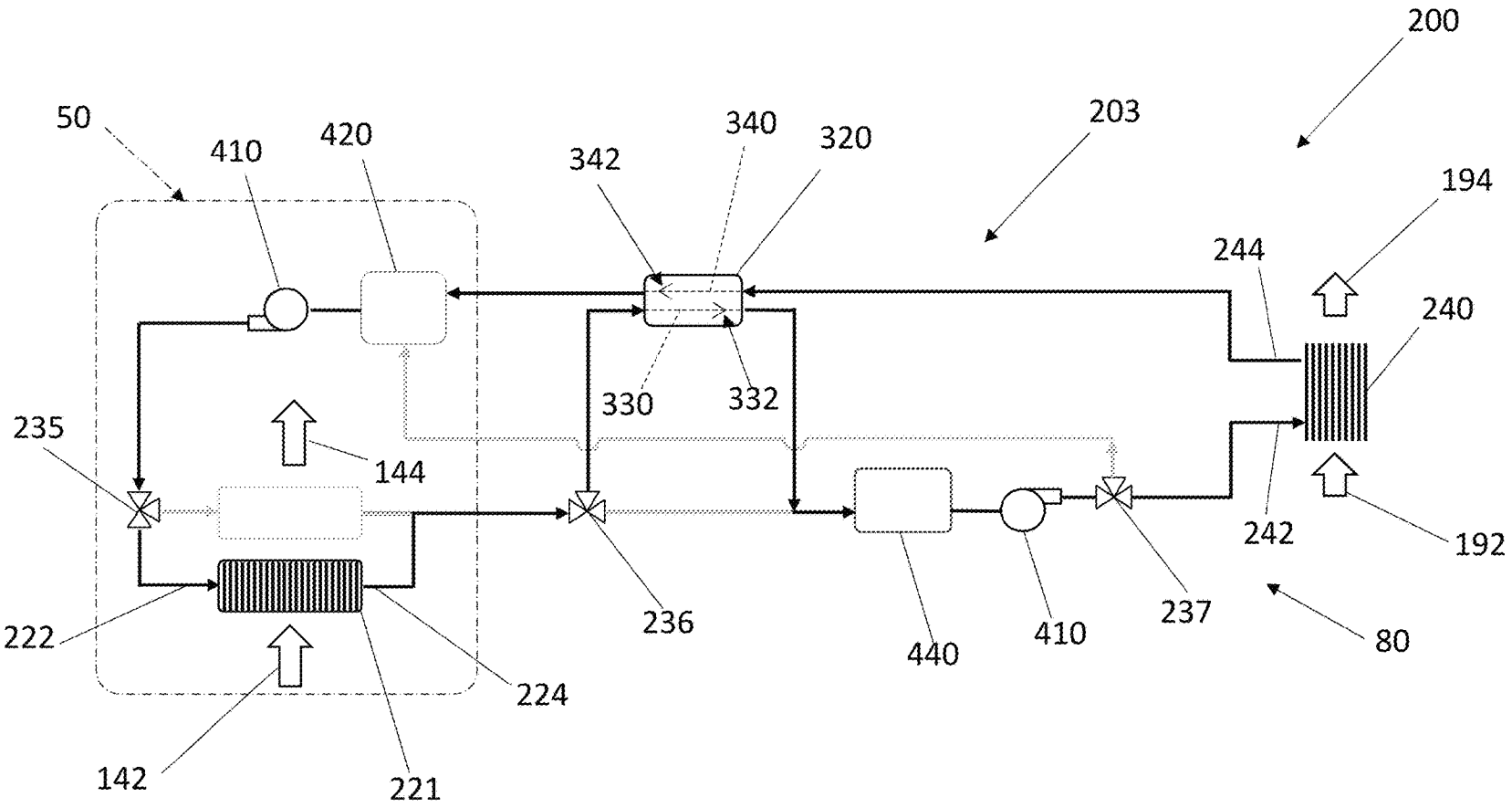
FIG. 10 is a schematic view of the evaporative cooling system shown in FIG. 2 configured to be used as a dehumidification system.

In further embodiments, the controller 510 is programmed to control operation of the evaporative cooling system 200 to dehumidify, rather than evaporatively cool, the conditioned interior space 50. In such embodiments, and with reference to FIG. 10, the controller 510 programs the first valve 235 to direct non-refrigerant active fluid through the heat and mass exchange device 221 to absorb moisture from the first airflow 142, and programs the third valve 237 to direct non-refrigerant active fluid through the mass exchange device 240 to release moisture into the second airflow 192. The controller 510 additionally programs the second valve 236 to direct non-refrigerant active fluid to a heat exchanger 320 in fluid communication between the heat and mass exchange device 221 and the mass exchange device 240.

The heat exchanger 320 includes a first path 330 and a second path 340 that are adjacent and thermally coupled to one another. The first path 330 of the heat exchanger 320 is in fluid communication with both the outlet 224 of the heat and mass exchange device 221 and an inlet 242 of the mass exchange device 240. The non-refrigerant active fluid exiting the heat and mass exchange device 221 is cold from thermal contact with the first airflow 142, and flows through the first path of the heat exchanger 320 in a first direction 332 oriented from the heat and mass exchange device 221 towards the mass exchange device 240.

The second path 340 of the heat exchanger 320 is in fluid communication with both an outlet 244 of the mass exchange device 240 and the inlet 222 of the heat and mass exchange device 221. The non-refrigerant active fluid exiting the mass exchange device 240 is warm from thermal contact with the second airflow 192, and flows through the second path 340 in a second direction 342 oriented from the mass exchange device 240 to the heat and mass exchange device 221. The thermal contact between the first path 330 and the second path 340 causes the warm non-refrigerant active fluid in the second path 340 to be pre-cooled prior to entering the heat and mass exchange device 221, increasing its capacity to absorb moisture from the first airflow. The thermal contact between the two paths 330, 340 also causes the cold non-refrigerant active fluid in the first path 330 to be pre-warmed prior to entering the mass exchange device 240, improving its ability to release moisture into the second airflow 192.

In the illustrated embodiment, the heat exchanger 320 is in a counterflow configuration, and the first and second directions 332, 342 are opposite, parallel directions. The counterflow configuration improves the effectiveness of the heat transfer between the first and second paths 330, 340. In further embodiments, the first and second directions 332, 342 may be perpendicular, parallel, or in any other suitable orientation.

The controller 510 may also control the relative concentrations of liquid desiccant and water in the non-refrigerant active fluid. For example, the concentration of the non-refrigerant active fluid can be controlled such that it absorbs moisture from the first airflow 142 in the heat and mass exchange device 221, thereby dehumidifying the conditioned interior space 50, and releases moisture into the second airflow 192 in the mass exchange device 240, thereby regenerating the non-refrigerant active fluid. Such a conditioning system is disclosed in U.S. patent application Ser. No. 17/644,887 which is incorporated by reference herein in its entirety.

Figure 11:
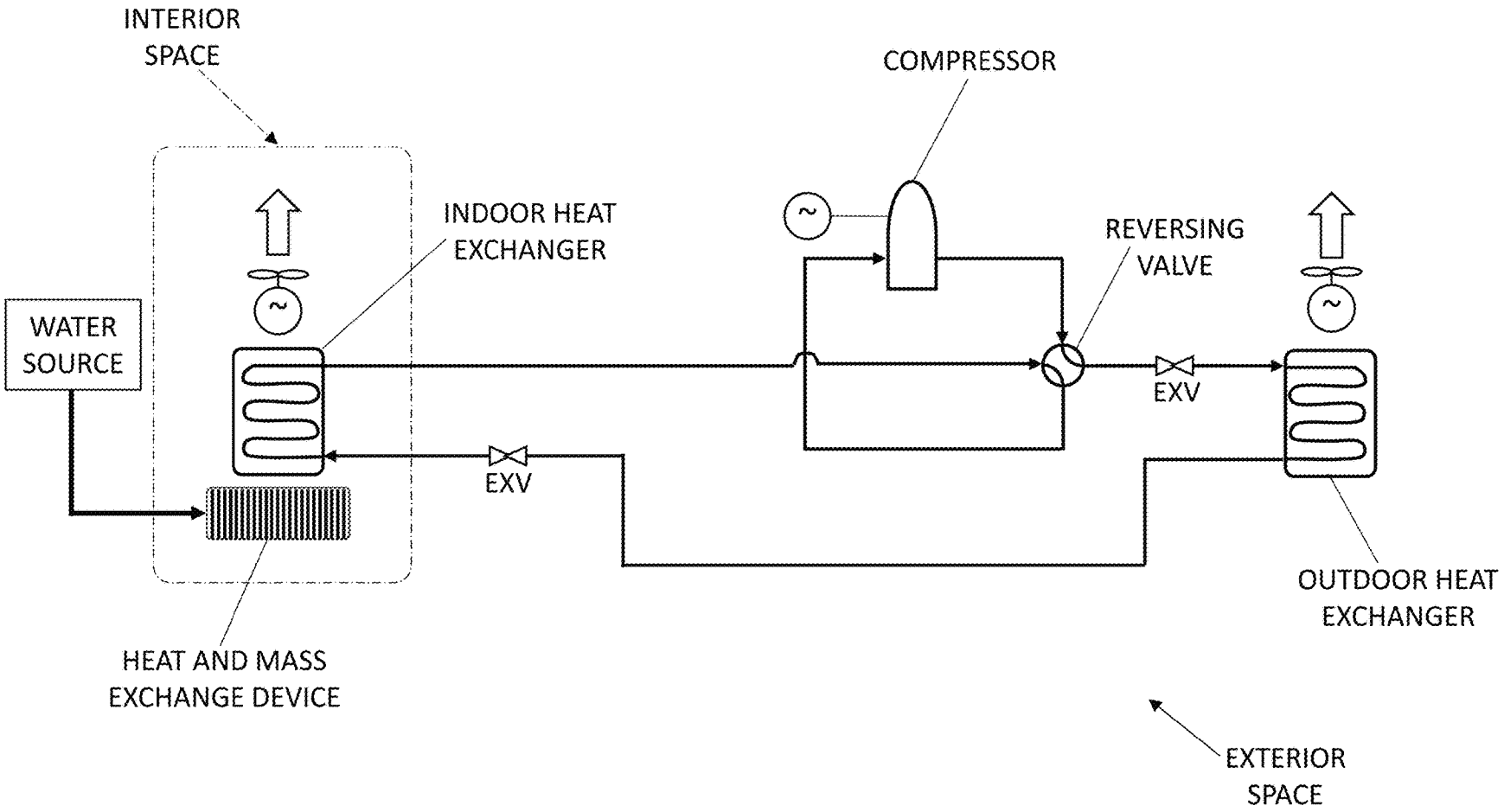
FIG. 11 is a schematic view of a water based heat and mass exchange device added to a reversible vapor compression system.

In further embodiments, a membrane based heat and mass exchange device similar to the heat and mass exchange devices described above may be added to other climate control systems to provide evaporative cooling or humidification using water. In such embodiments, the heat and mass exchange device may be connected to a water source, such as a municipal water source or a well, instead of being part of a liquid desiccant loop. Such embodiments are particularly well-suited for dry climates in which a supply of liquid water is available. For example, and with reference to FIG. 11, the heat and mass exchange device may be added to a reversible vapor compression system. Such a system may be configured either as a cooling system, with the heat and mass exchange device providing additional evaporative cooling, or as a heat pump, with the heat and mass exchange device providing additional humidification.

Figure 12:
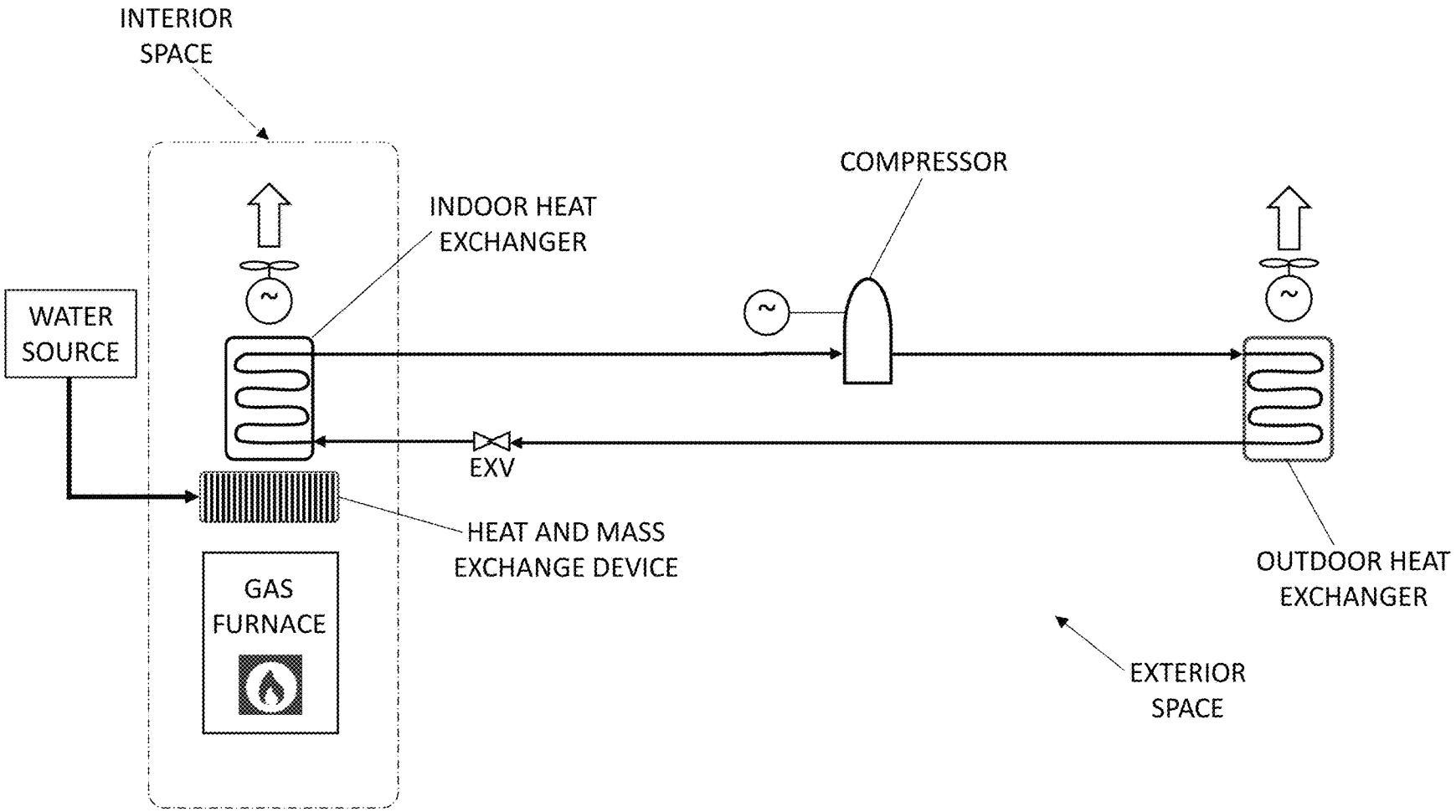
FIG. 12 is a schematic view of a water based heat and mass exchange device added to a system including a non-reversible vapor compression system and a gas furnace.

FIG. 12 illustrates another example system to which the heat and mass exchange device may be added. The illustrated system includes both a non-reversible vapor compression system configured to cool the interior space and a gas furnace configured to heat the interior space. The heat and mass exchange device may be used with the vapor compression system to provide additional evaporative cooling, or may be used with the gas furnace to provide humidification.

Figure 13:
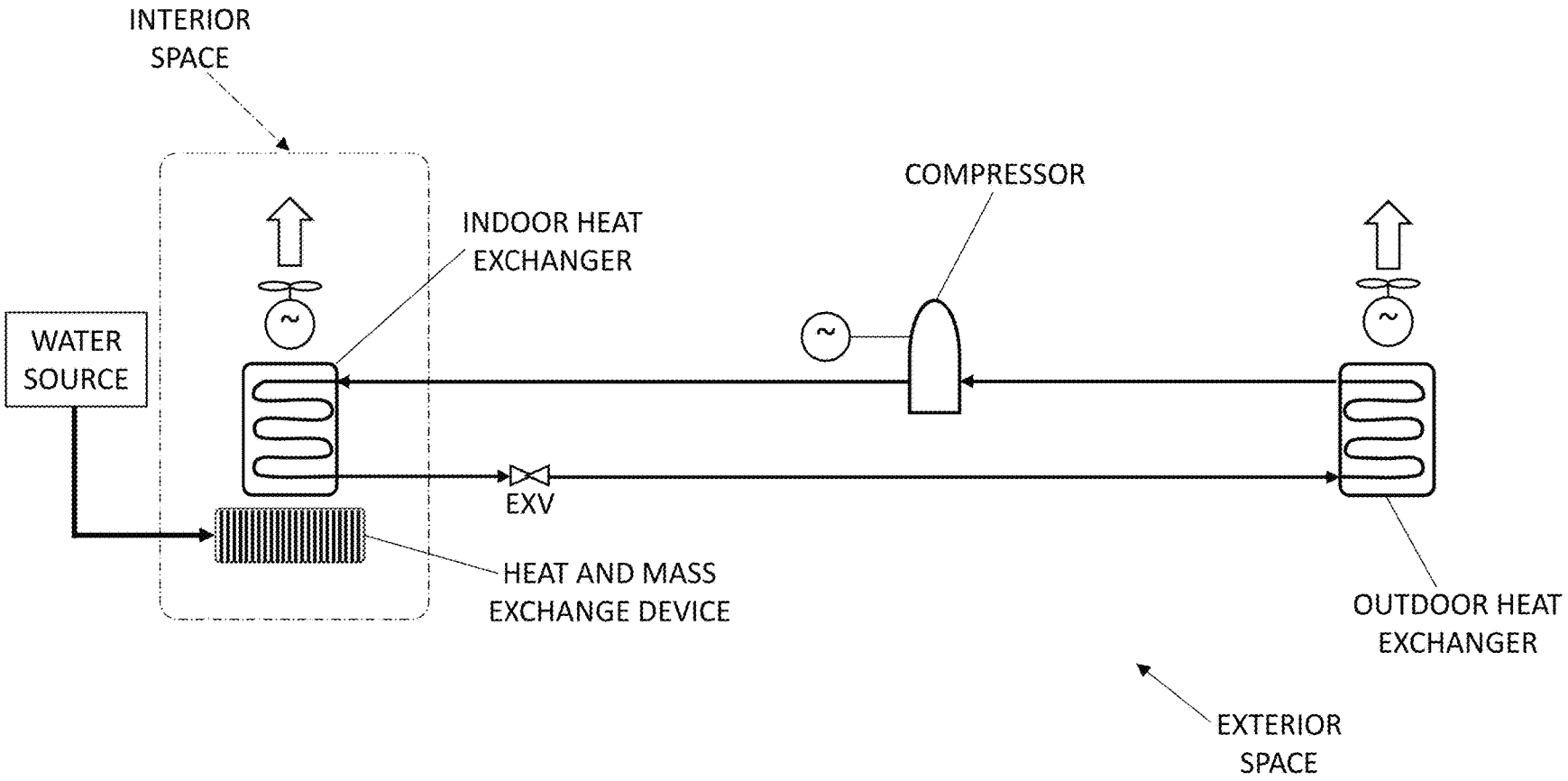
FIG. 13 is a schematic view of a water based heat and mass exchange added to a non-reversible vapor compression system configured as a heat pump.
Figure 14:
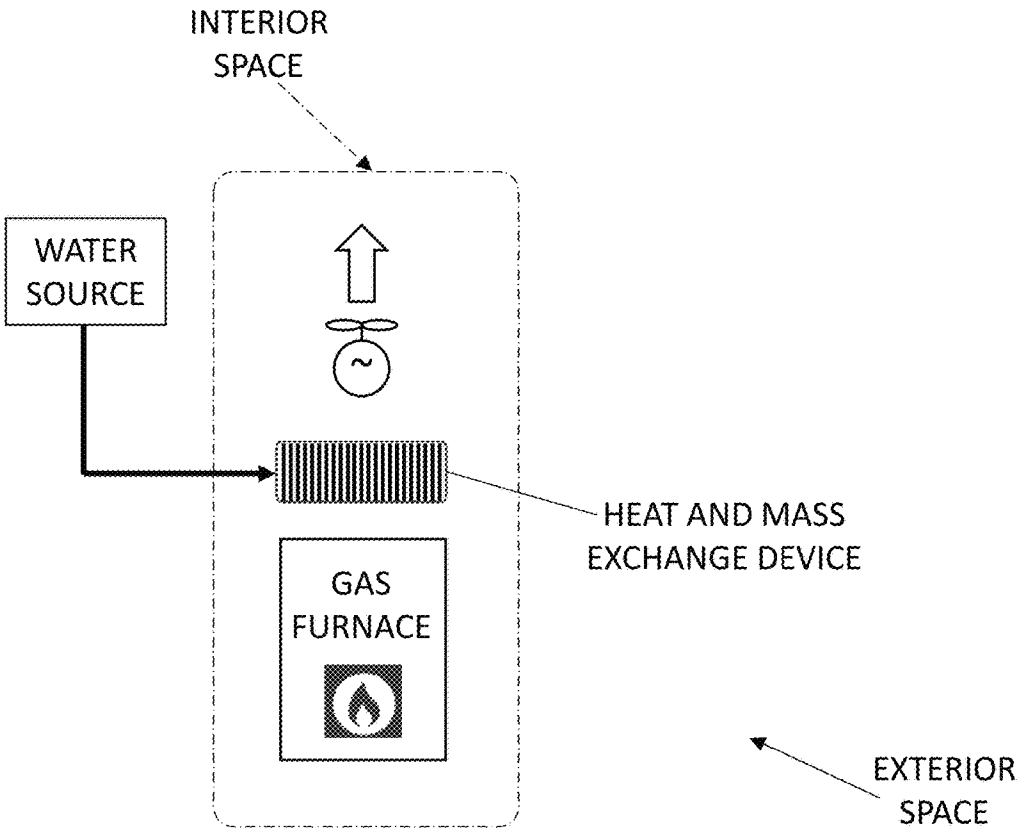
FIG. 14 is a schematic view of a water based heat and mass exchange device added to a gas furnace.

FIG. 13 illustrates the heat and mass exchange device as added to a non-reversible vapor compression system configured as a heat pump to heat the interior space. FIG. 14 illustrates the heat and mass exchange device as added to a gas furnace system configured to heat the interior space. In the embodiments illustrated in FIGS. 13 and 14, the heat and mass exchange device can provide additional humidification to the interior space.

Technical benefits of the systems described herein are as follows: (1) a single conditioning system can be controlled to cool, heat, humidify, and/or dehumidify an interior space, (2) the temperature and humidity of an indoor space can be separately regulated by cooperatively operating a vapor compression system with a refrigerant active fluid and an evaporative cooling system with a non-refrigerant active fluid, and (3) the non-refrigerant active fluid can effectively absorb and release moisture in a heat and/or mass exchange device through a vapor permeable membrane without contaminating the airflow with corrosive liquid desiccant.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A conditioning system for a conditioned interior space comprising:

a vapor compression system including:
- an evaporator,
- a condenser,
- a refrigerant active fluid for flowing between the evaporator and the condenser,
- a first fan to produce a first airflow toward the conditioned interior space, and
- a second fan for producing a second airflow from the condenser toward an exterior space;

an evaporative cooling system including:
- a first tank containing a non-refrigerant active fluid, and
- a heat exchange device fluidically coupled to the first tank to receive the non-refrigerant active fluid, wherein the first fan is positioned to produce the first airflow through the heat exchange device toward the conditioned interior space; and a controller programmed to control cooperative operation of the vapor compression system and the evaporative cooling system to condition the conditioned interior space.

2. The conditioning system of claim 1, wherein the non-refrigerant active fluid comprises water.

3. The conditioning system of claim 1, wherein the non-refrigerant active fluid comprises a liquid desiccant and water solution.

4. The conditioning system of claim 1, wherein the heat exchange device comprises a direct heat exchanger comprising a heat and mass exchange device.

5. The conditioning system of claim 4, wherein the heat and mass exchange device comprises an open fluid path for the non-refrigerant active fluid, the open fluid path including a vapor-permeable membrane to permit vapor evaporated from the non-refrigerant active fluid to pass into the first airflow.

6. The conditioning system of claim 1, wherein the heat exchange device comprises an indirect heat exchanger.

7. The conditioning system of claim 6, wherein the indirect heat exchanger comprises a sealed fluid path for the non-refrigerant active fluid, the sealed fluid path positioned to direct a flow of the non-refrigerant active fluid counter to the first airflow.

8. The conditioning system of claim 7 further comprising:

a second tank containing the non-refrigerant active fluid; and a mass exchange device to receive the non-refrigerant active fluid from the second tank and output the non-refrigerant active fluid to the first tank, wherein the second fan is positioned to produce the second airflow through the mass exchange device, and wherein the mass exchange device is configured to evaporate at least some of the non-refrigerant active fluid into the second airflow before the non-refrigerant active fluid is output to the first tank.

9. The conditioning system of claim 1, wherein the heat exchange device comprises a direct heat exchanger, an indirect heat exchanger, and a valve controlled by the controller for selecting whether to direct the non-refrigerant active fluid to the direct heat exchanger or the indirect heat exchanger.

10. The conditioning system of claim 9, wherein the controller is programmed to control operation of the vapor compression system and the evaporative cooling system to cooperatively condition the conditioned interior space to desired temperature and humidity levels.

11. An evaporative cooling system comprising:

a first fan for producing a first airflow toward a conditioned interior space;

a second fan for producing a second airflow toward an exterior space;

a first tank containing a non-refrigerant active fluid;

a second tank containing the non-refrigerant active fluid;

a mass exchange device coupled in fluid communication between the first tank and the second tank to receive the non-refrigerant active fluid from the second tank and output the non-refrigerant active fluid to the first tank, wherein the second fan is positioned to produce the second airflow through the mass exchange device, and wherein the mass exchange device is configured to evaporate at least some of the non-refrigerant active fluid into the second airflow before the non-refrigerant active fluid is output to the first tank;

a heat exchange device coupled in fluid communication with the first tank to receive the non-refrigerant active fluid, the heat exchange device including:

a direct heat exchanger, an indirect heat exchanger, and a valve for selecting whether to direct the non-refrigerant active fluid from the first tank to the direct heat exchanger or the indirect heat exchanger, wherein the first fan is positioned to produce the first airflow through the heat exchange device toward the conditioned interior space; and a controller programmed to control operation of the evaporative cooling system to condition the conditioned interior space using one of the direct heat exchanger and the indirect heat exchanger.

12. The evaporative cooling system of claim 11, wherein the non-refrigerant active fluid comprises water.

13. The evaporative cooling system of claim 11, wherein the non-refrigerant active fluid comprises a liquid desiccant and water.

14. The evaporative cooling system of claim 11, wherein the direct heat exchanger comprises a heat and mass exchange device.

15. The evaporative cooling system of claim 14, wherein the heat and mass exchange device comprises an open fluid path for the non-refrigerant active fluid, the open fluid path including a vapor-permeable membrane to permit vapor evaporated from the non-refrigerant active fluid to pass into the first airflow.

16. The evaporative cooling system of claim 11, wherein the indirect heat exchanger comprises a sealed fluid path for the non-refrigerant active fluid positioned to be within the first airflow.

17. The evaporative cooling system of claim 16, wherein the sealed fluid path is positioned to direct a flow of the non-refrigerant active fluid counter to the first airflow.

18. The evaporative cooling system of claim 11, wherein the controller is further programmed to control operation of a vapor compression system for conditioning the conditioned interior space.

19. The evaporative cooling system of claim 18, wherein the controller is further programmed to control the vapor compression system and the evaporative cooling system to cooperatively condition the conditioned interior space to a desired temperature and humidity.

20. The evaporative cooling system of claim 11, further comprising a valve for bypassing the mass exchange device when the controller controls operation of the evaporative cooling system to condition the conditioned interior space using the direct heat exchanger.

* * * * *